US010138767B2

(12) United States Patent
Kim

(10) Patent No.: US 10,138,767 B2
(45) Date of Patent: Nov. 27, 2018

(54) CONTINUOUS VARIABLE VALVE DURATION APPARATUS AND ENGINE PROVIDED WITH THE SAME

(71) Applicant: Hyundai Motor Company, Seoul (KR)

(72) Inventor: Kyung Mo Kim, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 122 days.

(21) Appl. No.: 15/264,449

(22) Filed: Sep. 13, 2016

(65) Prior Publication Data

US 2017/0114680 A1 Apr. 27, 2017

(30) Foreign Application Priority Data

Oct. 22, 2015 (KR) ..... 10-2015-0147615

(51) Int. Cl.

| | |
|---|---|
| ***F01L 1/34*** | (2006.01) |
| ***F01L 13/00*** | (2006.01) |
| ***F01L 1/047*** | (2006.01) |
| ***F01L 1/18*** | (2006.01) |
| ***F01L 1/053*** | (2006.01) |
| ***F01L 1/356*** | (2006.01) |
| *F01L 1/20* | (2006.01) |
| *F01L 1/26* | (2006.01) |

(52) U.S. Cl.

CPC ..... *F01L 13/0015* (2013.01); *F01L 1/047* (2013.01); *F01L 1/053* (2013.01); *F01L 1/18* (2013.01); *F01L 1/356* (2013.01); *F01L 13/0026* (2013.01); *F01L 1/181* (2013.01); *F01L 1/20* (2013.01); *F01L 1/267* (2013.01); *F01L 2001/0535* (2013.01); *F01L 2013/103* (2013.01); *F01L 2105/00* (2013.01)

(58) Field of Classification Search

CPC ..... F01L 13/0015; F01L 1/047; F01L 1/18; F01L 1/181; F01L 1/267; F01L 13/0026

USPC ..... 123/90.16, 90.39, 90.44

See application file for complete search history.

(56) References Cited

U.S. PATENT DOCUMENTS 9,574,467 B2 * 2/2017 Ha ..... F01L 13/0015 123/90.16

FOREIGN PATENT DOCUMENTS

| | | |
|---|---|---|
| JP | 2009-236010 A | 10/2009 |
| JP | 2015-117692 A | 6/2015 |

* cited by examiner

*Primary Examiner* — Ching Chang

(74) *Attorney, Agent, or Firm* — Morgan, Lewis & Bockius LLP

(57) ABSTRACT

A continuous variable valve duration system may include a camshaft, a first cam portion including a first cam, of which a relative phase angle of the first cam with respect to the camshaft is variable, an inner bracket transmitting rotation of the camshaft to the first cam portion, a slider housing on which a control slot is formed, the slider housing being rotatable around a pivot shaft, a first rocker arm including a first end contacting the first cam and a second end connected to a first valve, a rocker shaft to which the first rocker arm is rotatably connected, and onto which an eccentric shaft inserted into the control slot is formed, a duration controller configured to rotate the rocker shaft for the slider housing to move with respect to the camshaft, and an operation mode controller configured to change a position of the pivot shaft.

18 Claims, 11 Drawing Sheets

CONTINUOUS VARIABLE VALVE DURATION APPARATUS AND ENGINE PROVIDED WITH THE SAME

CROSS-REFERENCE TO RELATED APPLICATION

The present application claims priority to Korean Patent Application No. 10-2015-0147615, filed Oct. 22, 2015, the entire contents of which is incorporated herein for all purposes by this reference.

BACKGROUND OF THE INVENTION

Field of the Invention

Various aspects of the present invention relate to a continuous variable valve duration apparatus and an engine provided with the same. More particularly, to a continuous variable valve duration apparatus and an engine provided with the same which may vary opening duration of a valve according to operation conditions of an engine with a simple construction.

Description of Related Art

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various research, such as designing of a plurality of cams and a continuous variable valve lift (CVVL) that can change valve lift according to engine speed, has been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a continuous variable valve duration apparatus and an engine provided with the same which may vary opening duration of a valve according to operation conditions of an engine, with a simple construction.

A continuous variable valve duration apparatus according to various aspects of the present invention may be applied to a single overhead camshaft (SOHC) engine so as to reduce weight of the engine and driving resistance.

According to various aspects of the present invention, a continuous variable valve duration system may include a camshaft, a first cam portion including a first cam, into which the camshaft is inserted and of which a relative phase angle of the first cam with respect to the camshaft is variable, an inner bracket transmitting rotation of the camshaft to the first cam portion, a slider housing into which the inner bracket is rotatably inserted, and on which a control slot is formed, the slider housing being rotatable around a pivot shaft, a first rocker arm including a first end contacting the first cam and a second end connected to a first valve, a rocker shaft to which the first rocker arm is rotatably connected, and onto which an eccentric shaft inserted into the control slot is formed, a duration controller configured to rotate the rocker shaft for the slider housing to move with respect to the camshaft, and an operation mode controller configured to change a position of the pivot shaft.

A first and a second slot may be formed on the inner bracket, and the first cam portion may include a first wheel on which a first wheel key is formed, and connected to the first cam, and the continuous variable valve duration system may further include a second wheel on which a second wheel key is formed, and connected to the camshaft, a first slider pin on which a first pin hole where the first wheel key is slidably inserted thereto along a length direction of the first wheel key is formed, the first slider pin being rotatably inserted into the first slot, and a second slider pin, on which a second pin hole where the second wheel key is slidably inserted thereto along a length direction of the second wheel key is formed, the second slider pin being rotatably inserted into the second slot.

The duration controller may include a duration control gear connected to the rocker shaft, and a duration control motor configured to selectively rotate the duration control gear.

The operation mode controller may include a control rod rotatably connected to a cylinder head and connected to the pivot shaft, a mode control gear connected to the control rod, and a mode control motor engaged with the mode control gear, and selectively rotating the mode control gear to change the position of the pivot shaft.

The operation mode controller may include a control rod rotatably connected to a cylinder head and connected to the pivot shaft, a mode control gear connected to the control rod, and a mode control motor engaged with the mode control gear, and selectively rotating the mode control gear to change the position of the pivot shaft.

The continuous variable valve duration system may further include a bearing disposed between the slider housing and the inner bracket.

The continuous variable valve duration system may further include a first roller connected to a first end of the first rocker arm and contacting the first cam, and a first bridge connected to the second end of the first rocker arm, in which the first valve may be connected to the first bridge as a pair.

The continuous variable valve duration system may further include an outer shaft on which a guide slot is formed and into which the camshaft is inserted, and wherein the first cam may be connected to the outer shaft.

The continuous variable valve duration system may further include a second cam portion including a second cam shaft connected to the camshaft through the guide slot, and a second rocker arm rotatably connected to the rocker shaft, including a first end contacting the second cam and a second end connected to a second valve.

The continuous variable valve duration system may further include a second roller connected to the first end of the second rocker arm and contacting the second cam, and a second bridge connected to the second end of the second rocker arm, in which the second valve may be connected to the second bridge as a pair.

According to various aspects of the present invention, an engine may include a camshaft, a first cam portion including a first cam, into which the camshaft is inserted and of which a relative phase angle of the first cam with respect to the camshaft is variable, an inner bracket transmitting rotation of the camshaft to the first cam portion, a slider housing into which the inner bracket is rotatably inserted, and on which a control slot is formed, the slider housing being rotatable around a pivot shaft, a first rocker arm including a first end contacting the first cam, and a second end connected to a first valve, a rocker shaft to which the first rocker arm is rotatably connected, and onto which an eccentric shaft inserted into the control slot is formed, a duration controller configured to rotate the rocker shaft for the slider housing to move with respect to the camshaft and control opening and closing time of the first valve, and an operation mode controller configured to change a position of the pivot shaft to control an operation mode of the first valve.

The engine may further include a bearing disposed between the slider housing and the inner bracket.

The engine may further include a first roller connected to a first end of the first rocker arm, and contacting the first cam, and a first bridge connected to the second end of the first rocker arm, in which the first valve may be connected to the first bridge as a pair.

The engine may further include an outer shaft on which a guide slot is formed and into which the camshaft is inserted and wherein the first cam may be connected to the outer shaft.

The engine may further include a second cam portion including a second cam connected to the camshaft through the guide slot, and a second rocker arm rotatably connected to the rocker shaft, including a first end contacting the second cam and a second end connected to a second valve.

The engine may further include a second roller connected to the first end of the second rocker arm and contacting the second cam, and a second bridge connected to the second end of the second rocker arm, in which the second valve may be connected to the second bridge as a pair.

As described above, the continuous variable valve duration system according to various exemplary embodiments of the present invention may vary an opening duration of a valve according to operation conditions of an engine, with a simple construction.

Since the exemplary continuous variable valve duration system of various embodiments of the present invention may change a duration mode continuously, various valve profiles may be realized.

The exemplary continuous variable valve duration system of various embodiments of the present invention may be reduced in size and thus the entire height of a valve train may be reduced.

Since the continuous variable valve duration system may be applied to an existing engine without excessive modification, thus productivity may be enhance and production cost may be reduced.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
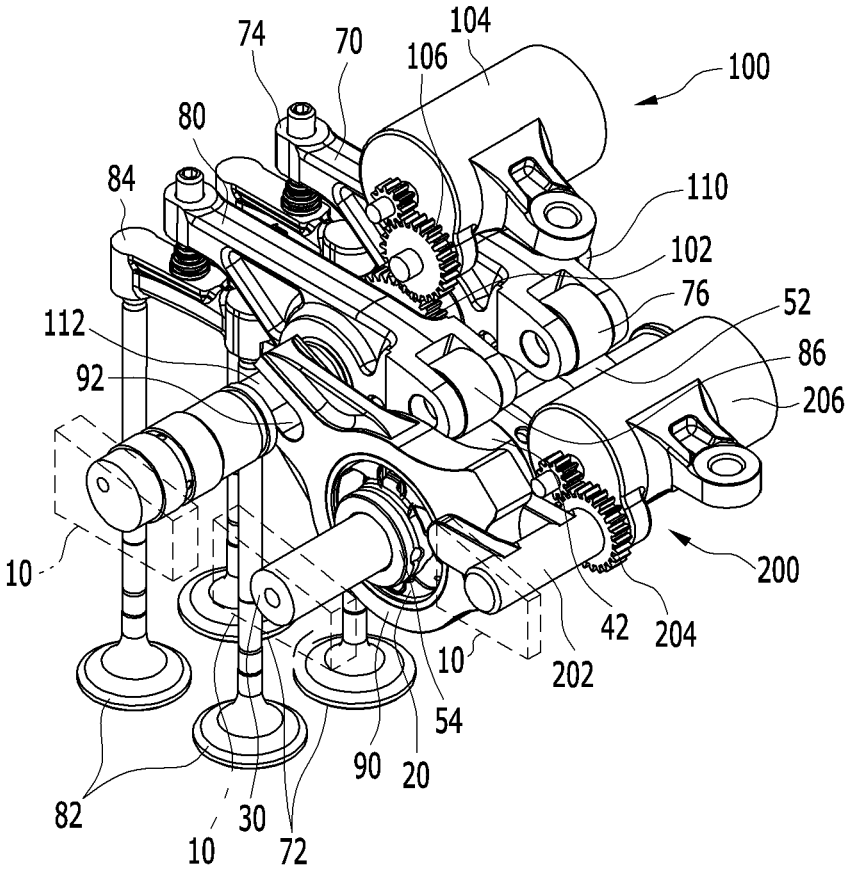
FIG. 1 is a perspective view of an engine provided with an exemplary continuous variable valve duration apparatus/system according to various embodiments of the present invention.
Figure 2:
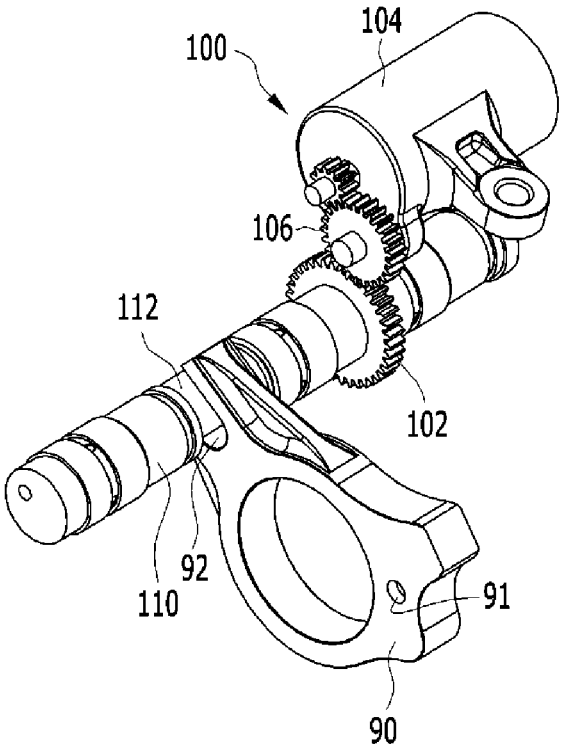
FIG. 2, FIG. 3, FIG. 4, and FIG. 5 are partial exploded perspective view of the exemplary continuous variable valve duration system according to various embodiments of the present invention.
Figure 3:
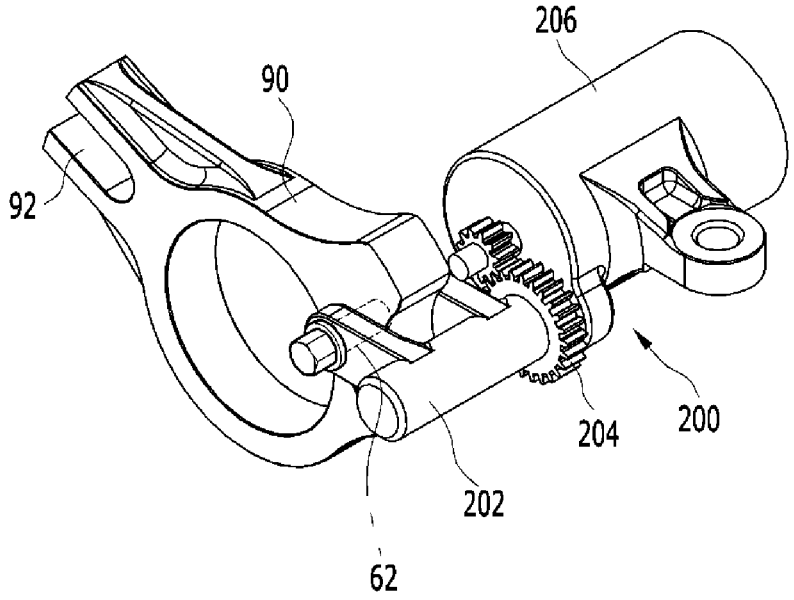
Figure 4:
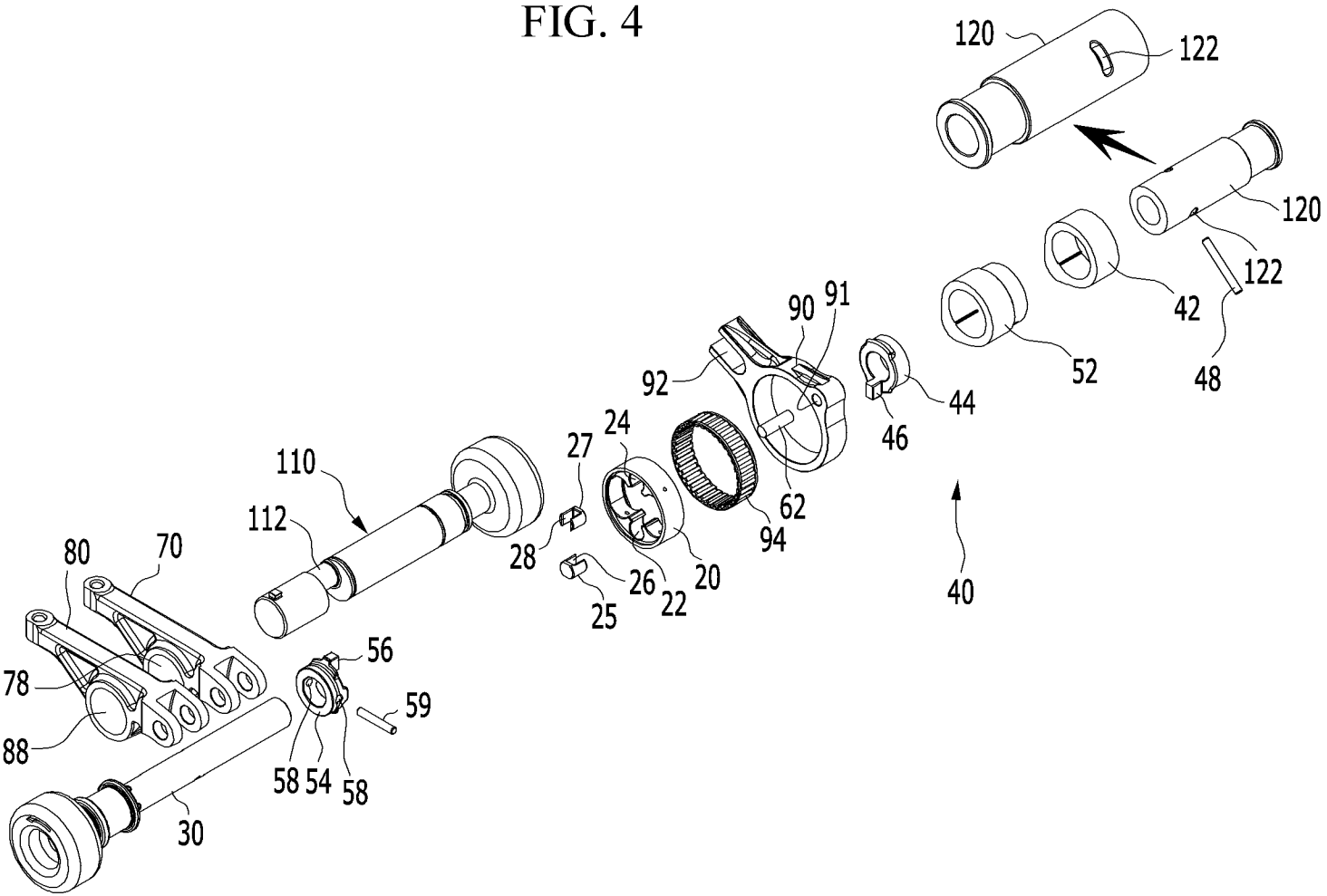
Figure 5:
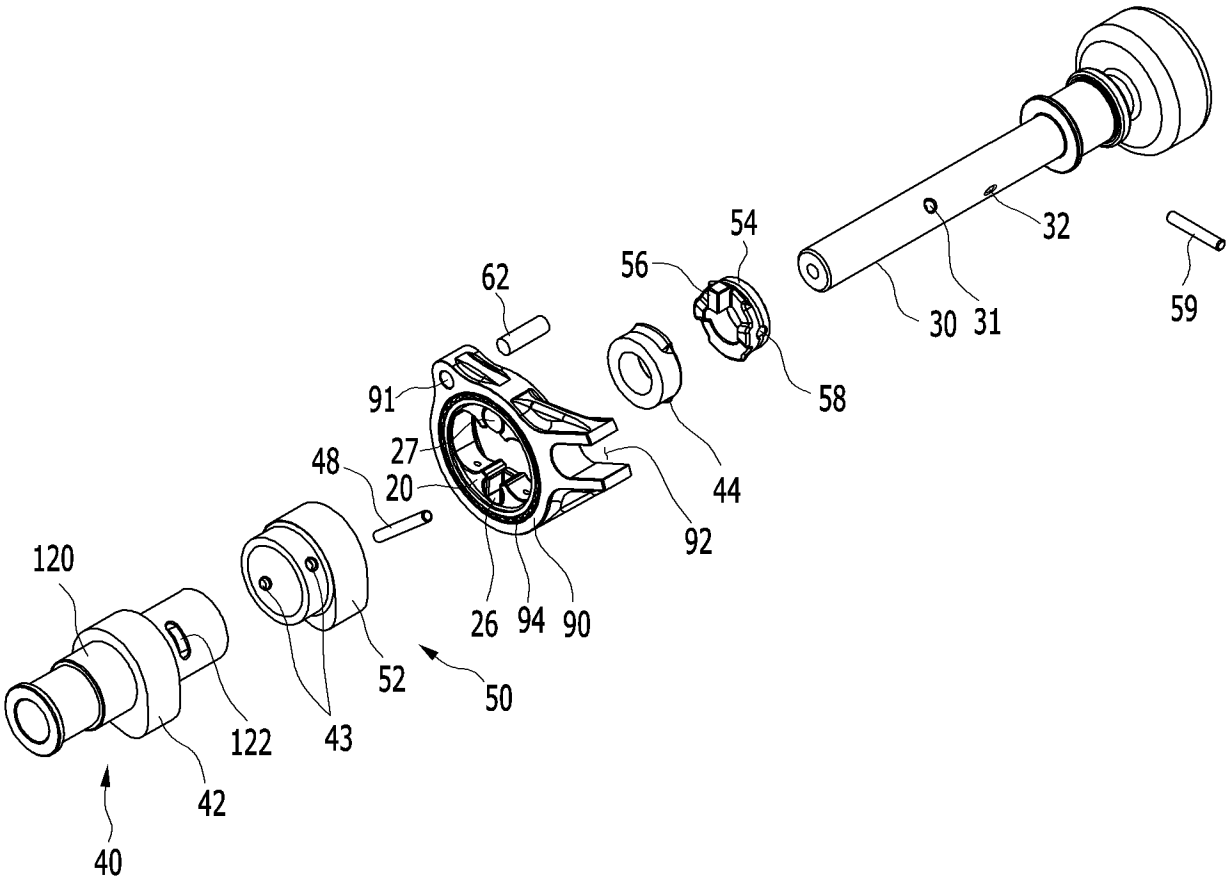

FIG. 1 is a perspective view of an engine provided with an exemplary continuous variable valve duration apparatus/system according to various embodiments of the present invention, and FIG. 2 to FIG. 5 are partial exploded perspective view of the exemplary continuous variable valve duration system according to various embodiments of the present invention.

Figure 6:
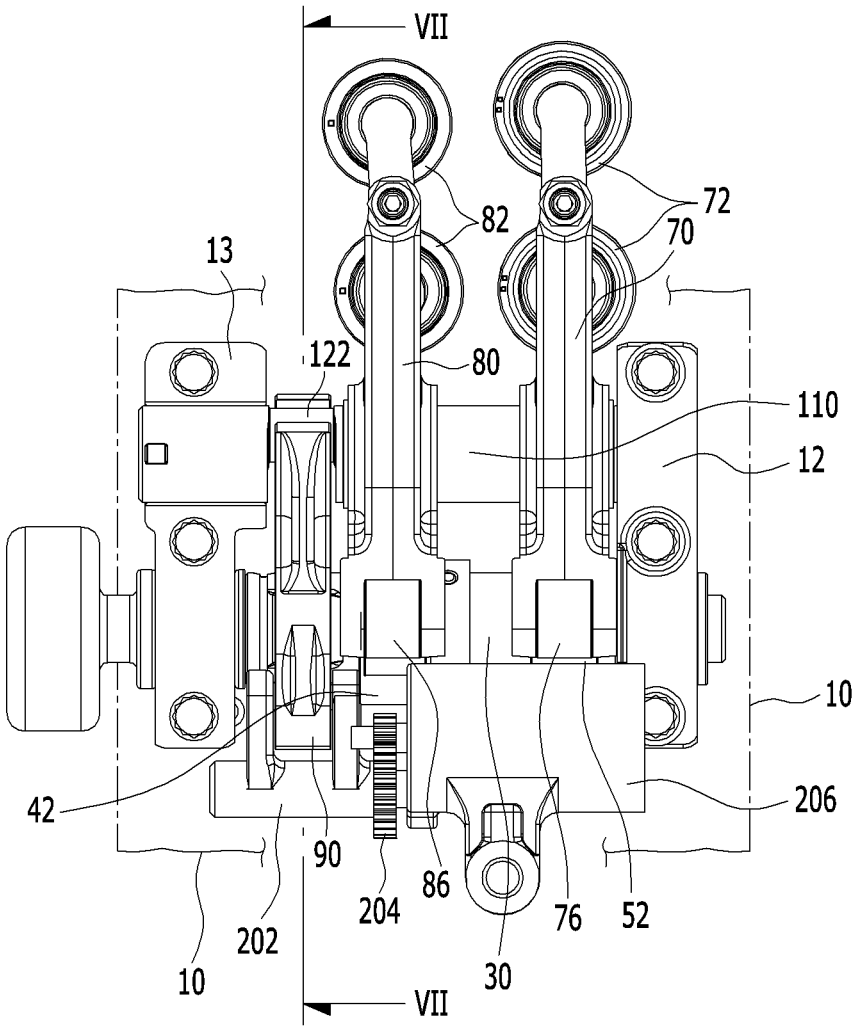
FIG. 6 is a top plan view of the exemplary continuous variable valve duration system according to various embodiments of the present invention.
Figure 7:
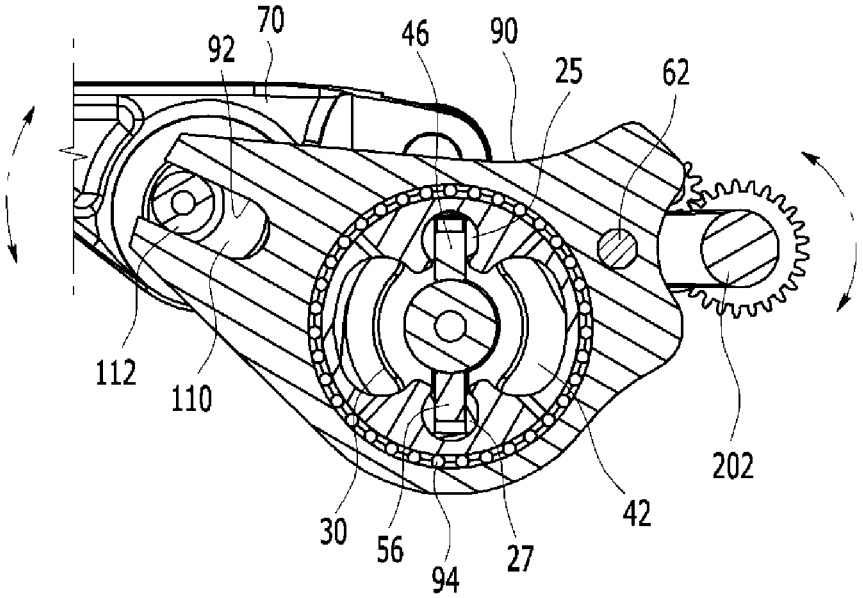
FIG. 7 is a cross-sectional view along line VII-VII of FIG. 6.

FIG. 6 is a top plan view of the exemplary continuous variable valve duration system according to various embodiments of the present invention and FIG. 7 is a cross-sectional view along line VII-VII of FIG. 6.

Referring to FIG. 1 to FIG. 7, an engine 10 according to various exemplary embodiments of the present invention includes a cylinder head 10 and a continuous variable valve duration system mounted to the cylinder head 10.

The continuous variable valve duration system includes a camshaft 30, a first cam portion 40 including a first cam 42, into which the camshaft 30 is inserted and of which a relative phase angle of the first cam 42 with respect to the camshaft 30 is variable, an inner bracket 20 transmitting rotation of the camshaft 30 to the first cam portion 40, a slider housing 90 into which the inner bracket 20 is rotatably inserted, on which a control slot 92 is formed, and the slider housing 90 rotatable around a pivot shaft 62, a first rocker arm 70 of which a first end contacts with the first cam 42 and of which a second end is connected to a first valve 72, a rocker shaft 110 of which the first rocker arm 70 is rotatably connected thereto and of which an eccentric shaft 112 inserted into the control slot 92 is formed thereto, a duration controller 100 conFIG. to rotate the rocker shaft 110 for the slider housing 90 to be moved with respect to the camshaft 30 and an operation mode controller 200 configured to change a position of the pivot shaft 62.

In the detailed description and claims, the cylinder head 10 may include a cam carrier.

A first and a second slot 22 and 24 are formed on the inner bracket 20.

The first cam portion 40 includes a first wheel 44 on which a first wheel key 46 is formed and connected to the first cam 42.

A second wheel 54 on which a second wheel key 56 is formed is connected to the camshaft 30. A wheel key hole 58 is formed on the second wheel 54, a camshaft hole 32 is formed on the camshaft 30, a wheel key pin 59 is inserted into the wheel key hole 58 and the camshaft hole 32 and thus the second wheel 54 is connected to the camshaft 30.

A first slider pin 25 on which a first pin hole 26 where the first wheel key 46 is slidably inserted thereto along a length direction of the wheel key 46 is formed is rotatably inserted into the first slot 22. A second slider pin 27, on which a second pin hole 28 where the second wheel key 56 is slidably inserted thereto along a length direction of the second wheel key 56 is formed, is rotatably inserted into the second slot 24.

A bearing 92 is inserted between the slider housing 90 and the inner bracket 20. Thus, rotation of the inner bracket 20 may be easily performed.

The duration controller 100 includes a duration control gear 102 connected to the rocker shaft 110 and a duration control motor 104 configured to selectively rotate the duration control gear 102. As shown in drawings, an intermediate gear 106 may be interposed between the duration control gear 102 and the duration control motor 104.

The operation mode controller 200 includes a control rod 202 rotatably connected to a cylinder head 10 and connected to the pivot shaft 62, a mode control gear 204 connected to the control rod 202 and a mode control motor 206 engaged with the mode control gear 204 and selectively rotating the mode control gear 204 to change the position of the pivot shaft 62.

The continuous variable valve duration system according to various exemplary embodiments of the present invention further includes a second cam portion 50 including a second cam 52 rotating with the same phase angle of the camshaft 30 and a second rocker arm 80 rotatably connected to the rocker shaft 110, a first end of which contacts the second cam 52 and a second end of which is connected with a second valve 82.

The camshaft 30 may be inserted into an outer shaft 120 where a guide slot 122 may be formed along a circumference direction thereof, and the first wheel 44 is connected to the outer shaft 120.

The first cam 42 is connected to and rotated with the outer shaft 120.

A cam pin 48 may be connected to the second cam 52 and the cam pin 48 is inserted into the guide slot 122 for guiding rotation of the second cam 52. A cam hole 43 may be formed to the second cam 52, the cam pin 48 is inserted into the cam hole 43 and a connecting hole 31 formed to the camshaft 30 and the cam pin 48 may be movably inserted into the guide slot 122. Thus the second cam 52 may relatively rotate with respect to the outer shaft 120 along a circumference direction of the outer shaft 120.

A first rocker arm hole 78 is formed on the first rocker arm 70, a second rocker arm hole 88 is formed on the second rocker arm 80 and the rocker shaft 110 is inserted into the first rocker arm hole 78 and the second rocker arm hole 88.

A first roller 76 contacting the first cam 42 is connected to the first end of the first rocker arm 70 and a first bridge 74 is connected to the second end of the first rocker arm 70.

The first valve 72 may be connected to the first bridge 70 as a pair.

A second roller 86 contacting the second cam 52 is connected to the first end of the second rocker arm 80 and a second bridge 84 is connected to the second end of the second rocker arm 80.

The second valve 82 may be connected to the second bridge 80 as a pair.

That is, the continuous variable valve duration system according to various exemplary embodiments of the present invention may be applied to a SOHC engine with light weight and with little driving resistance.

Referring to FIG. 1 to FIG. 7, operations of the continuous variable valve duration system according to various aspects of the present invention will be discussed.

When rotation centers of the camshaft 30 and the inner bracket 20 are coincident, the first cam 42 and the camshaft 30 rotate with the same speed.

In the case that the duration controller 100 is operated, the rotation centers of the inner bracket 20 and the camshaft 30 are not coincident, rotation speed of the first cam 42 with respect to rotation speed of the camshaft 30 is changed.

While the second wheel 54 is rotated together with the camshaft 30, the second wheel key 56 is movable within the second pin hole 28, the second slider pin 27 and the first slider pin 25 are rotatable within the second slot 24 and the first slot 22 respectively and the first wheel key 46 is movable within the first pin hole 26. Thus when the rotation centers of the camshaft 30 and the inner bracket 20 are not coincident, the rotation speed of the first cam 42 with respect to the rotation speed of the camshaft 30 is changed.

When the rotation center is changed due to the operation of the duration controller 100, timing of the first cam 42 to push the first roller 76 that is the timing of the first valve 72 is opened or closed is changed.

When the position of the pivot shaft 62 is changed due to the operation of the operation mode controller 200, an operation mode of the continuous variable valve duration system is changed.

FIG. 8 to FIG. 11 are graphs of a valve profile of the exemplary continuous variable valve duration system according to various embodiments of the present invention.

The continuous variable valve duration system according to various exemplary embodiments of the present invention may perform various valve profiles according to the operations of the operation mode controller 200 and the duration controller 100.

Figure 8:
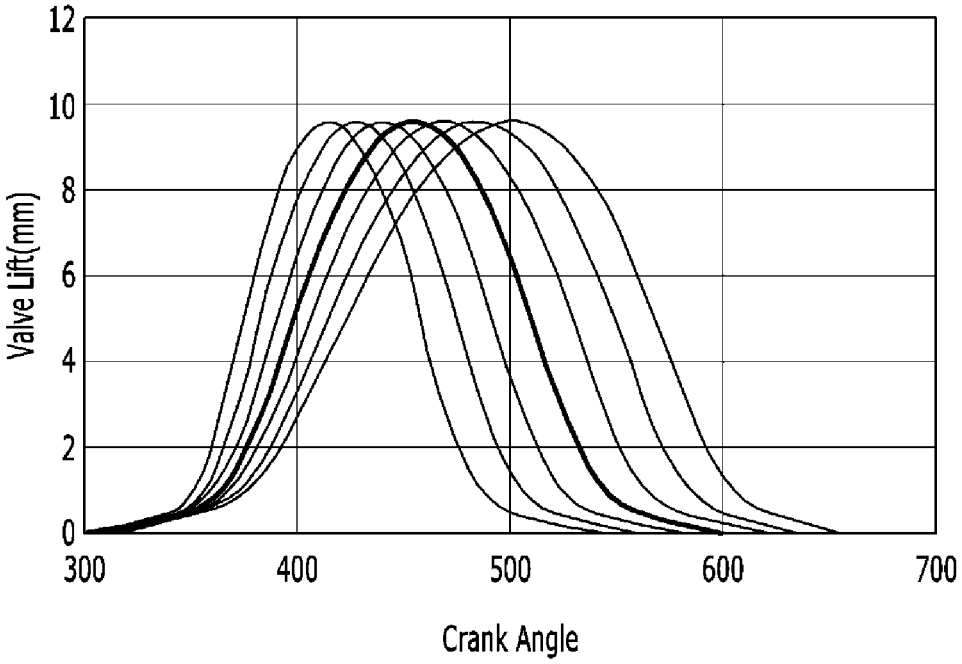
FIG. 8, FIG. 9, FIG. 10, and FIG. 11 are graphs of a valve profile of the exemplary continuous variable valve duration system according to various embodiments of the present invention.

As shown in FIG. 8, the continuous variable valve duration system may be operated in a mode of which opening time of the first valve 72 may be fixed while closing time of the first valve 72 is changed according to the position controlling of the pivot shaft 62 by the operation of the operation mode controller 200. In this case, the opening time of the first valve 72 may be fixed by the operation of the operation mode controller 200 and the closing time of the first valve 72 may be changed by the operation of the duration controller 100.

Figure 9:
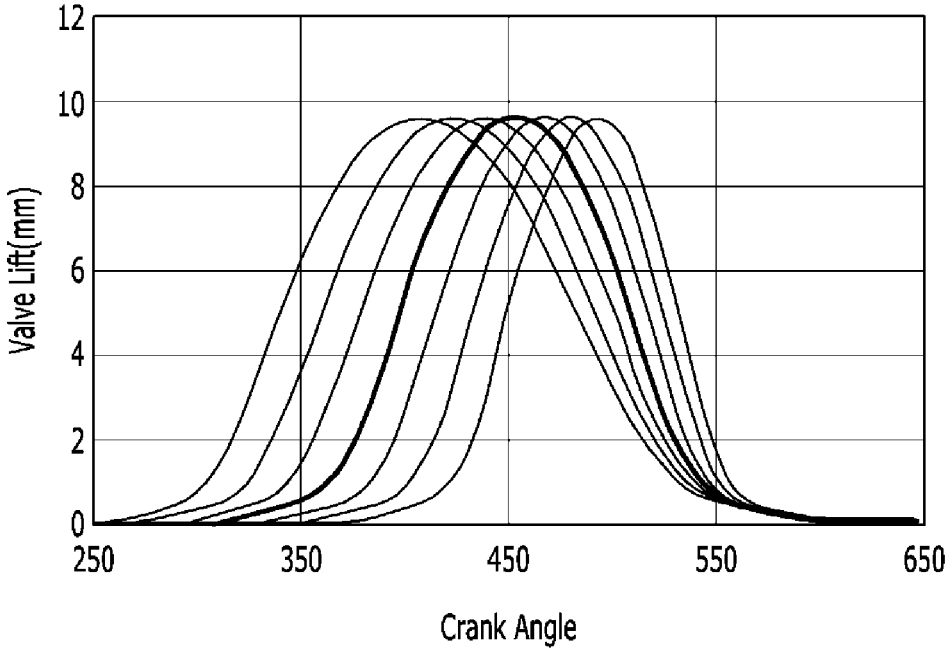

As shown in FIG. 9, the continuous variable valve duration system may be operated in a mode of which closing time of the first valve 72 may be fixed while opening time of the first valve 72 is changed according to the position controlling of the pivot shaft 62 by the operation of the operation mode controller 200. In this case, the closing time of the first valve 72 may be fixed by the operation of the operation mode controller 200 and the opening time of the first valve 72 may be changed by the operation of the duration controller 100.

Figure 10:
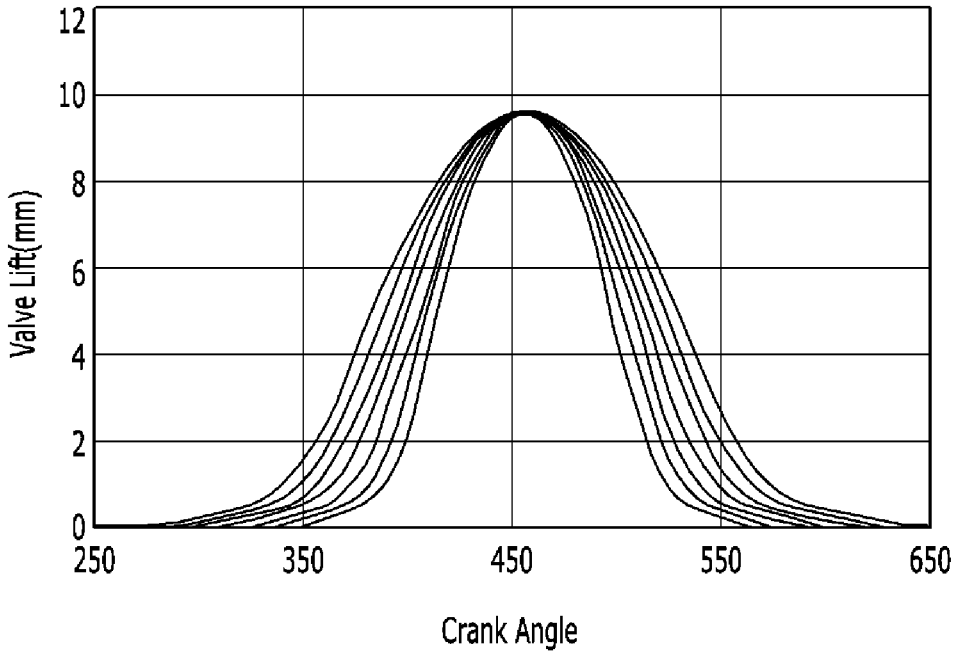

As shown in FIG. 10, the continuous variable valve duration system may be operated in a mode of which peak time of the first valve 72 may be fixed while opening and closing time of the first valve 72 is changed according to the position controlling of the pivot shaft 62 by the operation of the operation mode controller 200. In this case, the peak time of the first valve 72 may be fixed by the operation of the operation mode controller 200 and the opening time and closing time of the first valve 72 may be changed by the operation of the duration controller 100.

Figure 11:
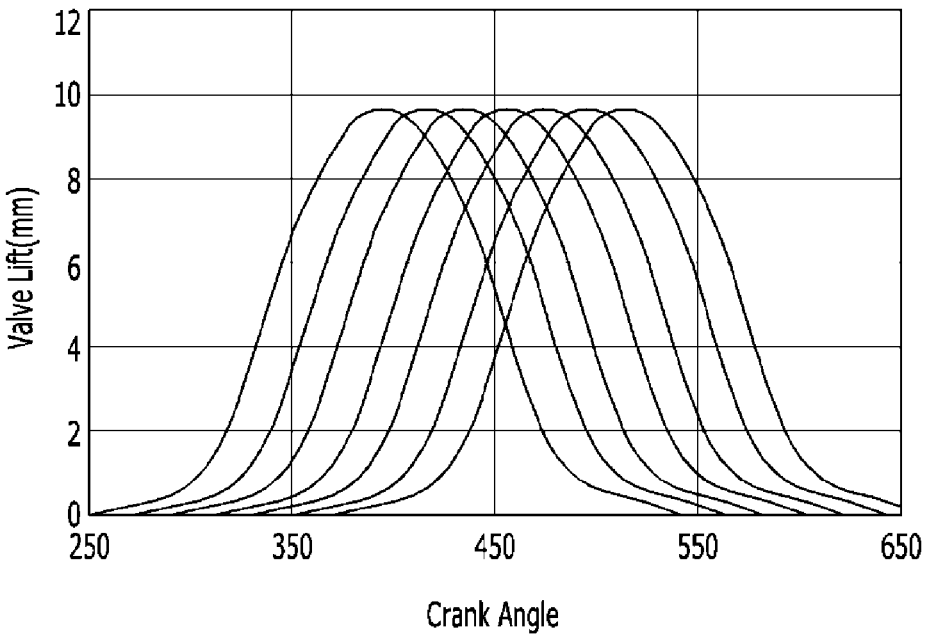

As shown in FIG. 11, the continuous variable valve duration system may be operated in a mode of which duration of the first valve 72 may be fixed while opening and closing time of the first valve 72 is changed according to the position controlling of the pivot shaft 62 by the operation of the operation mode controller 200. In this case, the duration of the first valve 72 may be fixed by the operation of the operation mode controller 200 and the opening time and closing time of the first valve 72 may be changed by the operation of the duration controller 100. That is, the continuous variable valve duration system according to the various exemplary embodiments of the present invention may be operated as a continuously variable valve timing device.

During controlling the valve duration and lift of the first valve 72, the duration and lift of the second valve 82 may be maintained constantly.

As described above, the continuous variable valve duration system according to various exemplary embodiments of the present invention may vary an opening duration of a valve according to operation conditions of an engine, with a simple construction.

Since the exemplary continuous variable valve duration system of the present invention may change a duration mode continuously, various valve profiles may be realized.

The exemplary continuous variable valve duration system according to various embodiments of the present invention may be reduced in size and thus the entire height of a valve train may be reduced.

Since the continuous variable valve duration system may be applied to an existing engine without excessive modification, thus productivity may be enhance and production cost may be reduced.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuous variable valve duration system comprising:

a camshaft;

a first cam portion including a first cam, into which the camshaft is inserted and of which a relative phase angle of the first cam with respect to the camshaft is variable;

an inner bracket transmitting rotation of the camshaft to the first cam portion;

a slider housing into which the inner bracket is rotatably inserted, and on which a control slot is formed, the slider housing being rotatable around a pivot shaft;

a first rocker arm including a first end contacting the first cam and a second end connected to a first valve;

a rocker shaft to which the first rocker arm is rotatably connected, and onto which an eccentric shaft inserted into the control slot is formed;

a duration controller configured to rotate the rocker shaft for the slider housing to move with respect to the camshaft; and an operation mode controller configured to change a position of the pivot shaft.

2. The continuous variable valve duration system of claim 1, wherein a first slot and a second slot are formed on the inner bracket, and the first cam portion comprises a first wheel on which a first wheel key is formed, and connected to the first cam, and wherein the continuous variable valve duration system further comprises:

a second wheel on which a second wheel key is formed, and connected to the camshaft;

a first slider pin on which a first pin hole where the first wheel key is slidably inserted thereto along a length direction of the first wheel key is formed, the first slider pin being rotatably inserted into the first slot; and a second slider pin, on which a second pin hole where the second wheel key is slidably inserted thereto along a length direction of the second wheel key is formed, the second slider pin being rotatably inserted into the second slot.

3. The continuous variable valve duration system of claim 1, wherein the duration controller comprises:

a duration control gear connected to the rocker shaft; and a duration control motor configured to selectively rotate the duration control gear.

4. The continuous variable valve duration system of claim 3, wherein the operation mode controller comprises:

a control rod rotatably connected to a cylinder head and connected to the pivot shaft;

a mode control gear connected to the control rod; and a mode control motor engaged with the mode control gear, and selectively rotating the mode control gear to change the position of the pivot shaft.

5. The continuous variable valve duration system of claim 1, wherein the operation mode controller comprises:

a control rod rotatably connected to a cylinder head and connected to the pivot shaft;

a mode control gear connected to the control rod; and a mode control motor engaged with the mode control gear, and selectively rotating the mode control gear to change the position of the pivot shaft.

6. The continuous variable valve duration system of claim 1, further comprising a bearing disposed between the slider housing and the inner bracket.

7. The continuous variable valve duration system of claim 1, further comprising:

a first roller connected to a first end of the first rocker arm and contacting the first cam; and a first bridge connected to the second end of the first rocker arm, wherein the first valve formed of two first valves is connected to the first bridge as a pair of the two first valves.

8. The continuous variable valve duration system of claim 1, further comprising an outer shaft on which a guide slot is formed and into which the camshaft is inserted, wherein the first cam is connected to the outer shaft.

9. The continuous variable valve duration system of claim 8, further comprising:

a second cam portion including a second cam connected to the camshaft through the guide slot; and a second rocker arm rotatably connected to the rocker shaft, including a first end contacting the second cam and a second end connected to a second valve.

10. The continuous variable valve duration system of claim 9, further comprising:

a second roller connected to the first end of the second rocker arm and contacting the second cam; and a second bridge connected to the second end of the second rocker arm, wherein the second valve formed of two second valves is connected to the second bridge as a pair of the two second valves.

11. An engine comprising:

a camshaft;

a first cam portion including a first cam, into which the camshaft is inserted and of which a relative phase angle of the first cam with respect to the camshaft is variable;

an inner bracket transmitting rotation of the camshaft to the first cam portion;

a slider housing into which the inner bracket is rotatably inserted, and on which a control slot is formed, the slider housing being rotatable around a pivot shaft;

a first rocker arm including a first end contacting the first cam, and a second end connected to a first valve;

a rocker shaft to which the first rocker arm is rotatably connected, and onto which an eccentric shaft inserted into the control slot is formed;

a duration controller configured to rotate the rocker shaft for the slider housing to move with respect to the camshaft and control opening and closing time of the first valve; and an operation mode controller configured to change a position of the pivot shaft to control an operation mode of the first valve.

12. The engine of claim 11, wherein the operation mode controller comprises:

a control rod rotatably connected to a cylinder head and connected to the pivot shaft;

a mode control gear connected to the control rod; and a mode control motor engaged with the mode control gear, and selectively rotating the mode control gear to change the position of the pivot shaft.

13. The engine of claim 12, wherein the duration controller comprises:

a duration control gear connected to the rocker shaft; and a duration control motor configured to selectively rotate the duration control gear.

14. The engine of claim 13, further comprising a bearing disposed between the slider housing and the inner bracket.

15. The engine of claim 13, further comprising:

a first roller connected to a first end of the first rocker arm, and contacting the first cam; and a first bridge connected to the second end of the first rocker arm, wherein the first valve of two first valves is connected to the first bridge as a pair of the two first valves.

16. The engine of claim 13, further comprising an outer shaft on which a guide slot is formed and into which the camshaft is inserted, wherein the first cam is connected to the outer shaft.

17. The engine of claim 16, further comprising:

a second cam portion including a second cam connected to the camshaft through the guide slot; and a second rocker arm rotatably connected to the rocker shaft, including a first end contacting the second cam and a second end connected to a second valve.

18. The engine of claim 17, further comprising:

a second roller connected to the first end of the second rocker arm and contacting the second cam; and a second bridge connected to the second end of the second rocker arm, wherein the second valve of two second valves is connected to the second bridge as a pair of the two second valves.

* * * * *